US005870962A

United States Patent [19]

Ku

[11] Patent Number: 5,870,962

[45] Date of Patent: Feb. 16, 1999

[54] THREAD CUTTING DEVICE FOR A SEWING MACHINE OF CHAIN SEWING

[76] Inventor: Fei-Lung Ku, No. 10, Alley 6, Lane 148, Kai Yuan Road, Tainan, Taiwan

[21] Appl. No.: 968,475

[22] Filed: Nov. 12, 1997

[51] Int. Cl.[6] ..... D05B 65/00

[52] U.S. Cl. ..... 112/292; 112/298

[58] Field of Search ..... 112/292, 298, 112/296

[56] References Cited

U.S. PATENT DOCUMENTS

| | | | |
|---|---|---|---|
| 4,098,209 | 7/1978 | Schopf | 112/298 |
| 4,726,305 | 2/1988 | Seto | 112/298 |
| 5,416,119 | 5/1995 | Ikeda | 112/296 |
| 5,469,798 | 11/1995 | Gauch | 12/298 |
| 5,481,994 | 1/1996 | Ku | 112/298 |

*Primary Examiner*—Ismael Izaguirre
*Attorney, Agent, or Firm*—Rosenberg Klein & Bilker

[57] ABSTRACT

A thread cutting device for a sewing machine of chain sewing includes a fixing plate, a combine plate on the fixing plate, a slide guider movably combined with the combine plate by a swing arm located between the fixing plate and the combine plate. A main knife is fixed on a front end of combine plate, and a movable knife is fixed on the slide guider to be moved moved back and forth by the slide guider so that the movable knife may hook and retract threads for the main knife to cut off when the swing arm is swung by an air pressure cylinder having its piston rod connected with an second end of the swing arm, while a first end of the swing arm is connected with the slide guider.

7 Claims, 12 Drawing Sheets

THREAD CUTTING DEVICE FOR A SEWING MACHINE OF CHAIN SEWING

BACKGROUND OF THE INVENTION

This invention relates to a thread cutting device for a sewing machine of chain sewing, particularly to one having an extending distance of a movable knife shortened to make sure thread hooking and cutting process, and able to adjust an error of the extending distance of the movable knife if it should occur.

A variety of sewing machines are in use in textile industry, and the sewing machine of chain sewing is widely utilized, with a thread cutting device added on the table of the sewing machine for automatically hooking and cutting threads when sewing operation is finished for enhancing working efficiency.

A conventional thread cutting device for the sewing machine of chain sewing shown in FIGS. 17 and 18 includes a clamping device 10, a swing arm 20, a slide guider 30 and a fixing plate 40.

The clamping device includes a movable knife 101, a main knife 102, an upper lamp 103, and a lower clamp 104 combined together. The main knife 102, the upper and the lower clamp 103 and 104 are fixed on a front end of the fixing plate 40 after combined together, with the movable knife 101 protruding through the clamp device 10 and fixed on a front end of the slide guider 30. The swing arm 20 is fixed at a point in an intermediate portion with the table of the sewing machine to function as a fulcrum, having a long slot 202 in an outer end for a slide pin 301 of the slide guider 3 to fit and move therein. The slide guider 30 is fitted in a limit opening 401 of the fixing plate 40, and the swing arm 20 has its inner end connected with a transmitting unit of the sewing machine so that the swing arm may be swung to force the slide guider moved back and forth. Further, the fixing plate 40 has a hole 402 respectively in four corners for screws to fix the whole cutting device on the table of the sewing machine.

Next, referring to FIG. 18, in operation of the sewing machine, a weaving thread or warp 50 moves up and down with the needle to insert in a surface of a cloth being sewn, forming circles 501, and a woof 601 insertted through the hook maker 60 may protrude in the circles 501 by movement of the hook maker 60, and then both the warp 50 and the woof 601 are pulled by the cloth for a certain length, and forcing them 50 and 60 twist together to form a stitch on the rear side of the cloth, completing sewing operation.

In cutting the threads or the warp 50 and the woof 601 on completion of sewing, the movable knife 101 is extended forward by the swing arm 20, with a front hook 105 of the movable knife 101 inserting through and expanding the warp 50 as shown in FIG. 19. Next, the movable knife 101 continues to extend forward and passes through the circles 501 to reach an outermost point and stop there as shown in FIG. 20. Then the movable knife 101 begins to be retracted back, with the front hook 105 and the rear hook 106 of the movable knife 101 respectively hooking the woof 601 and the warp 50 and retracting them to reach an innermost point as shown in FIG. 21. Then the warp 50 hooked is cut off by the main knife knife 102, and the woof 601 is cut off and clamped between the upper and the lower clamp 103 and 104 as shown in FIG. 22. Thus, thread cutting operation is completed, and the thread cutting device is ready for the next sewing operation.

However, the conventional thread cutting device has been found to have disadvantages as follows.

1. The hook maker 60 moves for a certain angle with the up and down movement of the needle, and if the needle moves up and down 3000 times per minute, the hook maker 60 also moves the same times. And the thread cutting device has to be installed enough far from the hook maker so as to avoid moving scope of the hook maker to protect the cutting device from damaged by collision with the hook maker. Thus, the moving distance of the movable knife 101 has to be lengthened for smoothly hooking and cutting the threads so that its extending-out distance may easily cause malfunction of thread hooking and cutting, with the threads to be anew inserted through the eye of the needle and thus causing troubles to a worker.
2. The thread cutting device is located comparatively far from the hook maker and the needle, the threads protrude out too long after they are cut, retracted by the movable knife, impairing outer appearance of a finished product.
3. The fixing plate is fixed on the table of a sewing machine with screws engaging holes in four corners, so the screws have to be loosened and removed if the whole thread cutting device should be adjusted in location so as to keep cutting process smooth after a period of use. So it needs a troublesome work to adjust its location.

The above conventional thread cutting device for a sewing machine of chain sewing is disclosed in a U.S. patent Ser. No. 548199 by the same inventor of this new application.

SUMMARY OF THE INVENTION

The main purpose of the present invention is to offer a thread cutting device improving the conventional one for a sewing machine of chain sewing.

A feature of the invention is a swing arm having one end combined in a long slot of a slide guider and a curved guide slot of a lower combine plate to position the slide guider, the lower combine plate and the movable knife together at the outside of the table of a sewing machine so as to avoid swinging space of a hook maker, and position the whole thread cutting device comparatively near the hook maker, and then extending-out distance of the movable knife may be shortened than the conventional one, accurately performing thread hooking and cutting.

Another feature of the invention is a cylindrical gasket pivotally connecting the swing arm with the fixing plate to let the swing arm swing with the gasket functioning as a fulcrum, and the cylindrical gasket has a lower protruding edge of an eccentric shape so that the cylindrical gasket may be easily rotated for a little angle to let extending-out distance of the movable knife minutely adjusted if it becomes not accurate to extend out.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
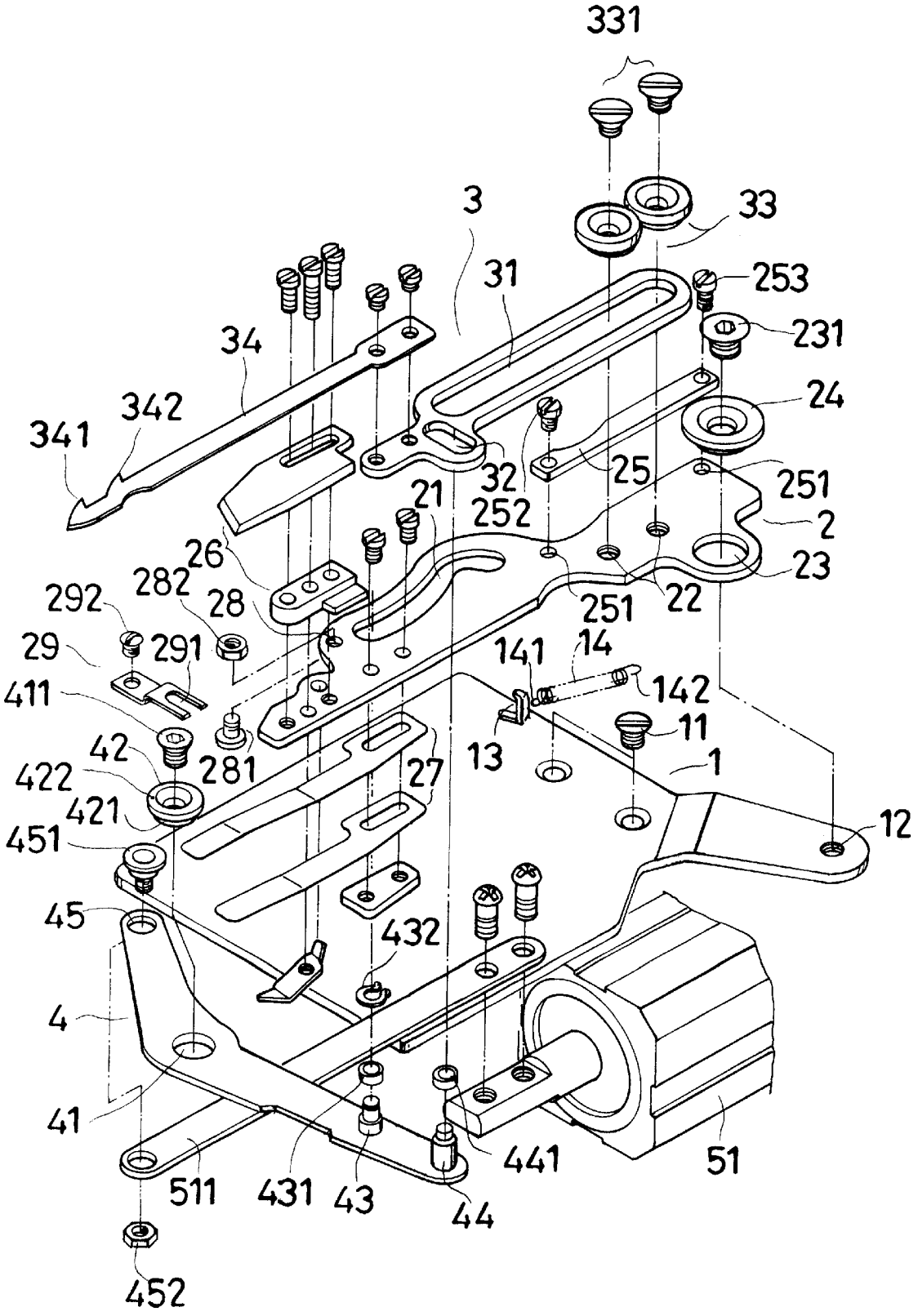
FIG. 1 is an exploded perspective view of a thread cutting device for a sewing machine of chain sewing in the present invention.
Figure 2:
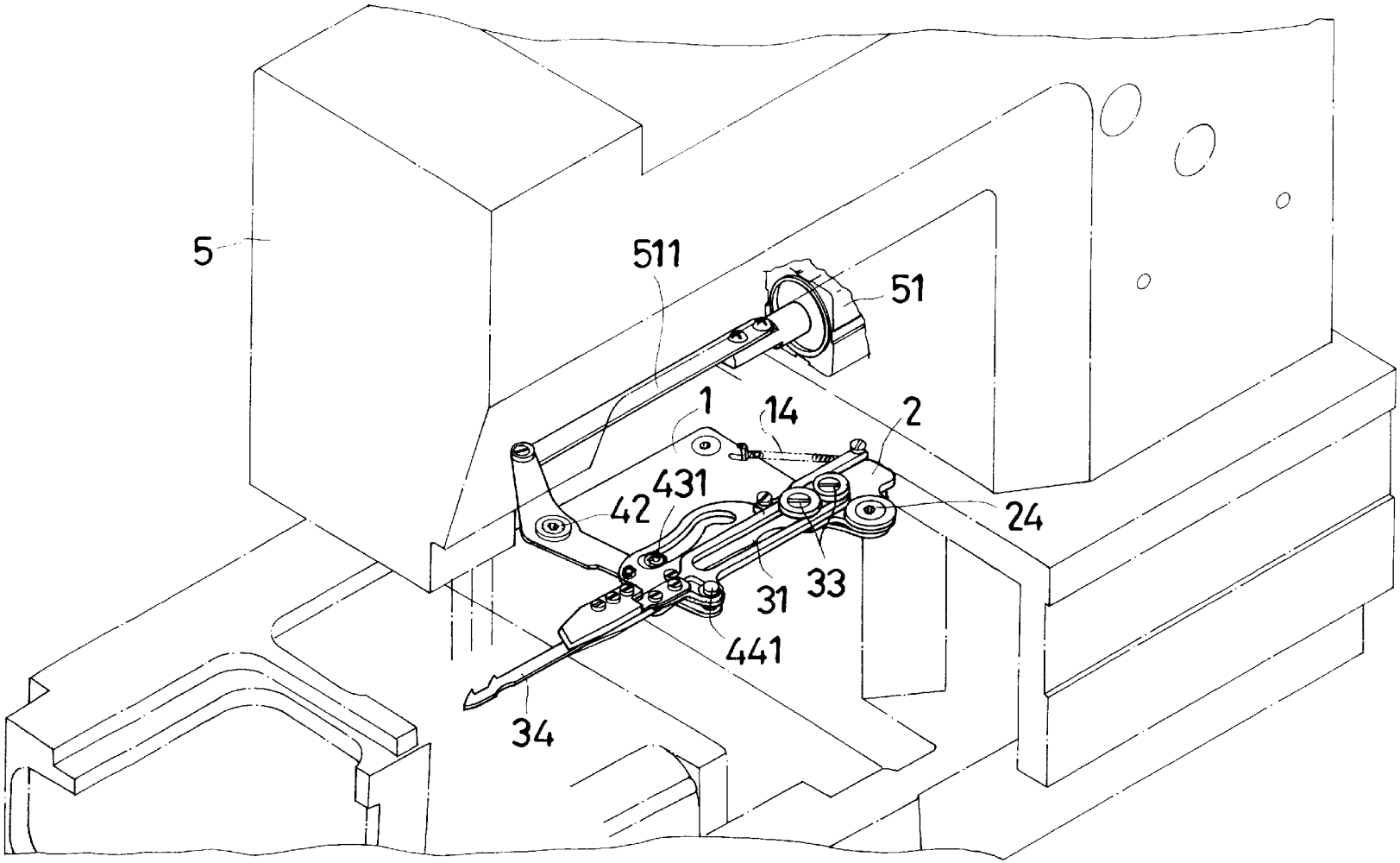
FIG. 2 is a perspective view of the thread cutting device for a sewing machine of chain sewing in the present invention, showing it installed in a sewing machine.

A preferred embodiment of a thread cutting device for a sewing machine of chain sewing, as shown in FIGS. 1 and 2, includes a fixing plate 1, a combine plate 2, a slide guider 3, and a swing arm 4 as main components combined with a sewing machine 5 and an air pressure cylinder 51.

The fixing plate 1 is shaped as pre-set, screwed tightly on a table of a sewing machine with bolts 11, having a threaded hole 12 in a projecting portion, an L-shaped piece 13 on a proper location of an upper surface for a first end 141 of a spring 14 to hook on.

Figure 3:
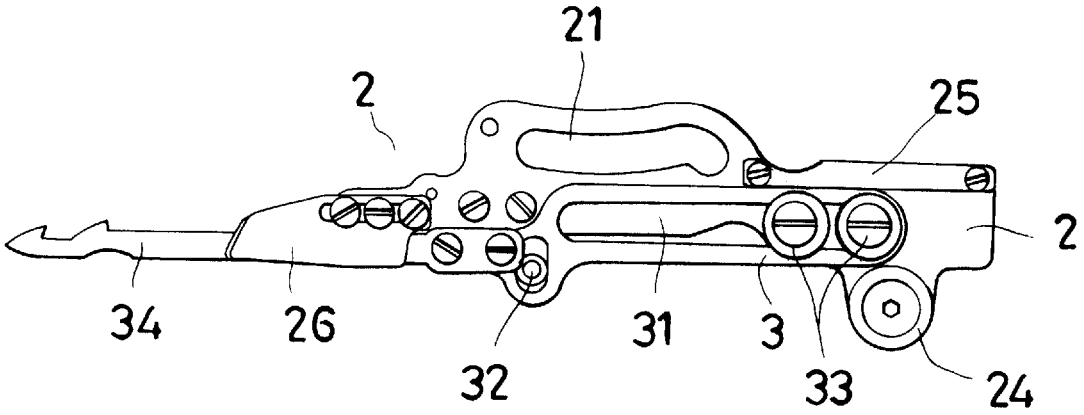
FIG. 3 is an upper view of the thread cutting device for a sewing machine of chain sewing in the present invention.
Figure 4:
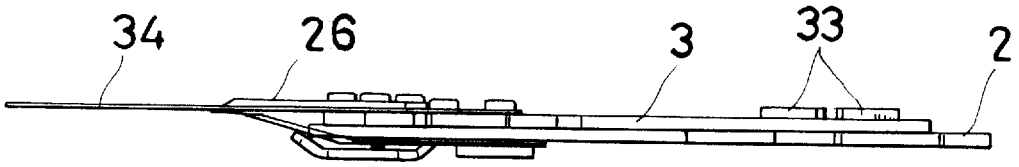
FIG. 4 is a front view of the thread cutting device for a sewing machine of chain sewing in the present invention.
Figure 5:
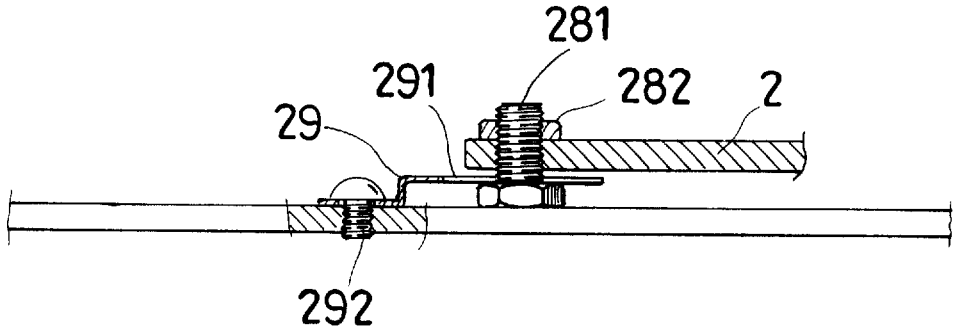
FIG. 5 is a cross-sectional view of an elastic guider of a lower combine plate combined with related components in the present invention.

The combine plate 2, as shown in FIGS. 3 and 4, has a curved slot 21 of a certain curvature in an intermediate portion, plural threaded holes 22 and a position hole 23 in a right side portion. The position hole 23 is for a bolt 231 to screw with and also with the threaded hole 12 of the fixing plate 1 to fix the combine plate 2 with the fixing plate 1. The combine plate 2 further has plural threaded holes 251 in right side portion for for bolts 252, 253 to engage with to fix the guider 25 with the combine plate 2. A spring 14 has a second end hooked with a lower end of the bolt 253. Further, the combine plate 2 has its front end combined with a main knife 26 and a pair of clamps 27, and a combine holes 28 for a bolt 281 and nut 282 to fit through and secure a U-shaped groove 291 of an elastic guider 29 under the head of the bolt 281 as shown in FIG. 5, with the mouth of the U-shaped groove 291 facing in a same direction as movement of this cutting device, and with the other end of the elastic guider 29 fixed tightly on the position plate 1 with a bolt 292.

The slide guider 3 is combined on the combine plate 2, having a long slot 31 and a short slot 32. The long slot 31 is for plural cylindrical gaskets 33 to fit and move in, and the gaskets 33 are also fixed in combine holes 22 of the combine plate 2 with bolts 331. Then the slide guider 3 has a bottom side resting on the guider 25 of the combine plate 2. At the same time, the movable knife 34 is screwed tightly with screws on the the front end of the slide guider 3, and the movable knife 34 has a front hook 341 and a rear hook 342 in a front end.

Figure 6:
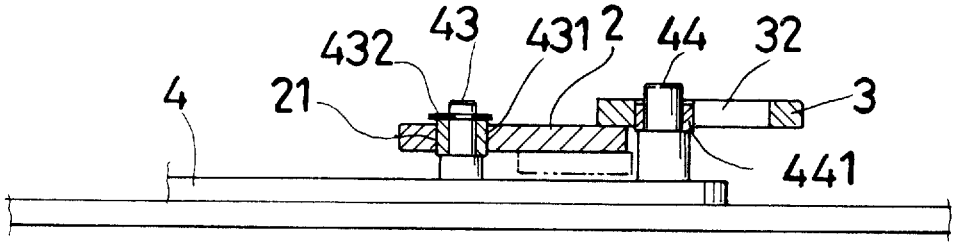
FIG. 6 is a cross-sectional view of a swing arm, the lower combine plate and a slide guider combined together in the present invention.
Figure 7:
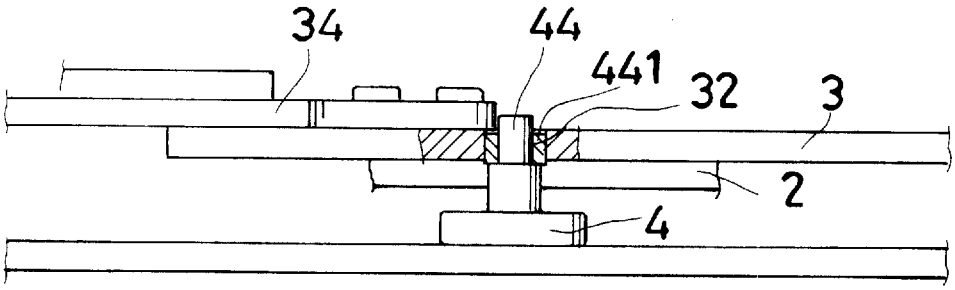
FIG. 7 is a partial cross-sectional view of a post of the swing arm combined with the slide guider in the present invention.

The swing arm 4 has a hole 41 in a middle portion for a bolt 411 to engage a cylindrical gasket 42 and connected pivotally with the swing arm 4 on the fixing plate, with the gasket 42 functioning as a fulcrum. The cylindrical gasket 42 has a lower eccentric edge 421 and a mark 422 on an upper surface. The swing arm 4 further has a first post 43 and a second post 44 on one end for limit washers 431 , 441 to fit around, and the two posts 43, 44 fit through the curved guide slot 21 of the combine plate 2 and the short slot 32 of the slide guider 3. Besides, the first post 43 is locked by a C-shaped lock washer 432 on the upper end after protruding the guide slot 21 of the combine plate 2 as shown in FIG. 6. The second post 44 is properly pushed by the movable knife 34 on the slide guider 3 after protruding the limit washer 441 and the long slot 32 of the slide guider 3, as shown in FIG. 7. Further, the swing arm 4 has in another end a combine hole 45 connected pivotally with a piston rod 511 of an air pressure cylinder 51 with a bolt 451 and nut 452.

Figure 8:
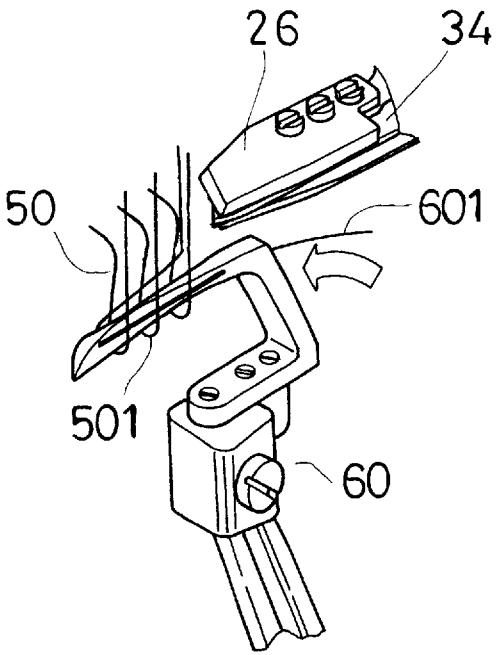
FIG. 8 a perspective view of relative position of the thread cutting device and a hook maker in moving condition in the present invention.
Figure 9:
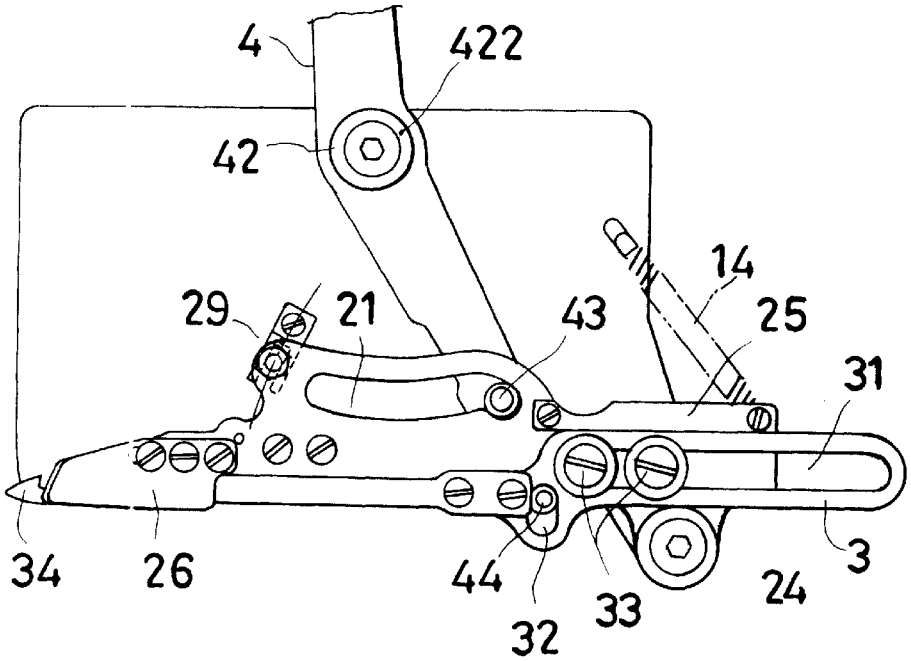
FIG. 9 is a side view of the thread cutting device in a first operation stage wherein the movable knife is at a start point in the present invention.

After the thread cutting device is installed on a sewing machine, as shown in FIG. 8, the hook maker 60, around which circulating thread or woof 601 surrounds, moves up and down for a preset angle along a needle of a weaving thread 50 or warp in operation, and the thread cutting device is located at the outside of the table of the sewing machine, avoiding the swaying space of the hook maker 60.

Figure 10:
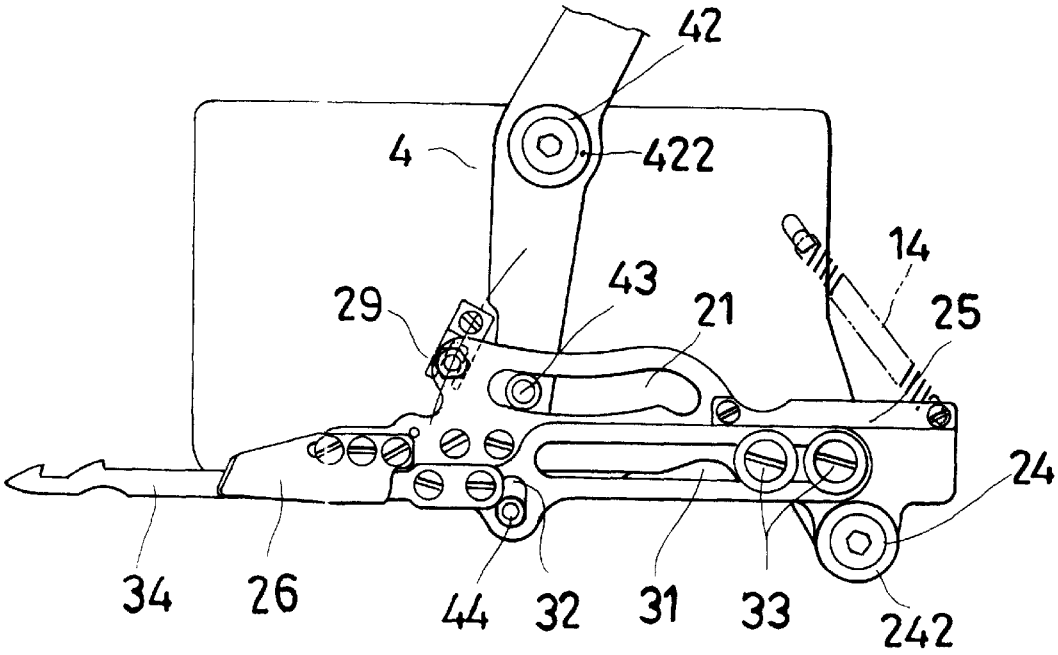
FIG. 10 is a side view of the thread cutting device in a second operation stage wherein the movable knife is being extended out in the present invention.
Figure 12:
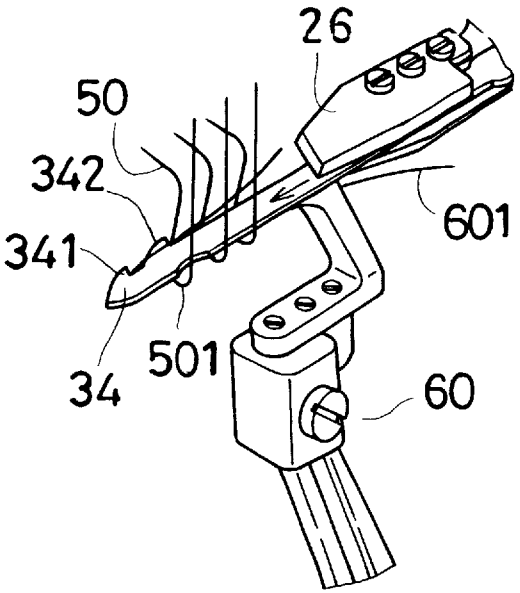
FIG. 12 is a perspective view of the thread cutting device in a third operation stage wherein the movable knife is extended out to an outermost position relative to the hook maker in the present invention.
Figure 11:
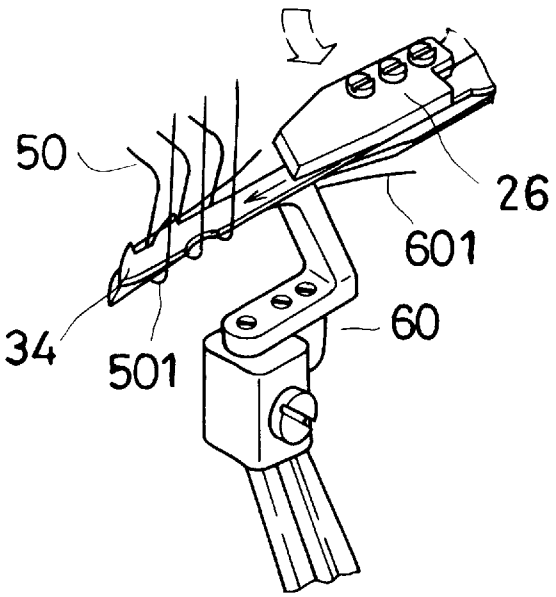
FIG. 11 is a perspective view of the thread cutting device in the second operation stage wherein the movable knife is extended out relative to the hook maker in the present invention.
Figure 14:
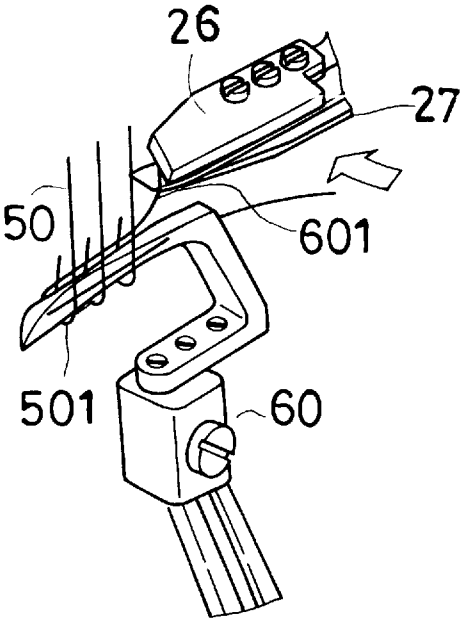
FIG. 14 is a perspective view of the thread cutting device in a fifth operation stage wherein the cutting device is retracted to the starting point in the present invention.
Figure 13:
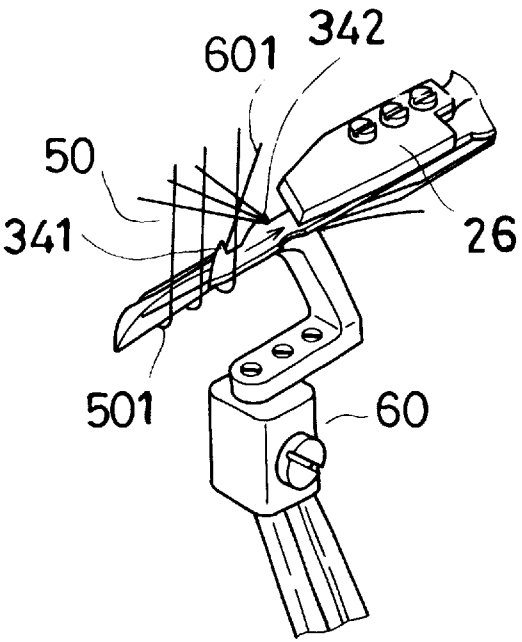
FIG. 13 is perspective view of the thread cutting device in a fourth operation stage wherein the movable knife is being retracted back relative to the hook maker in the present invention.
Figure 15:
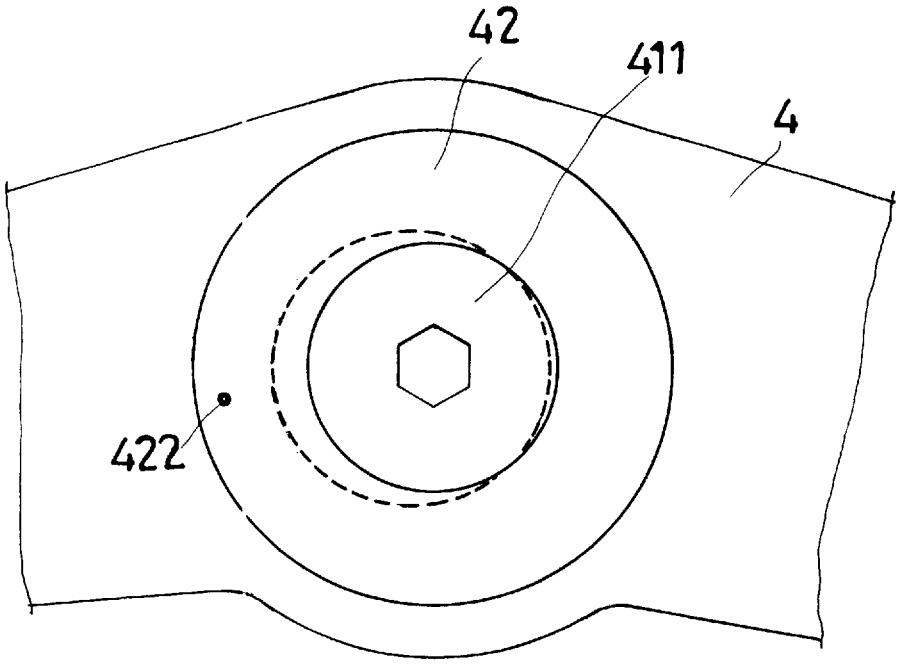
FIG. 15 is an upper view of a cylindrical gasket of the swing arm in the present invention.
Figure 16:
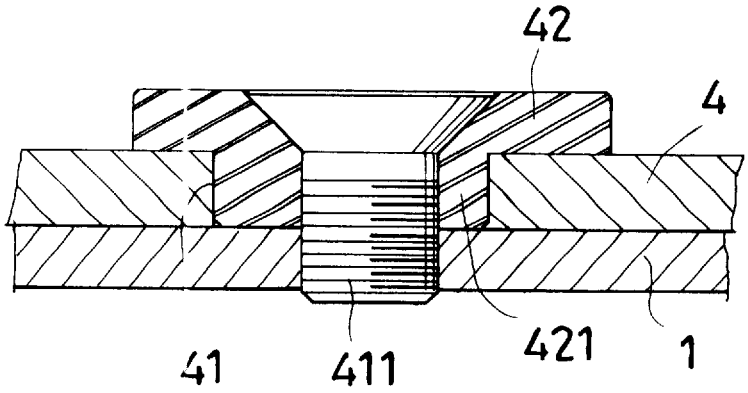
FIG. 16 is a cross-sectional view of FIG. 15.
Figure 17:
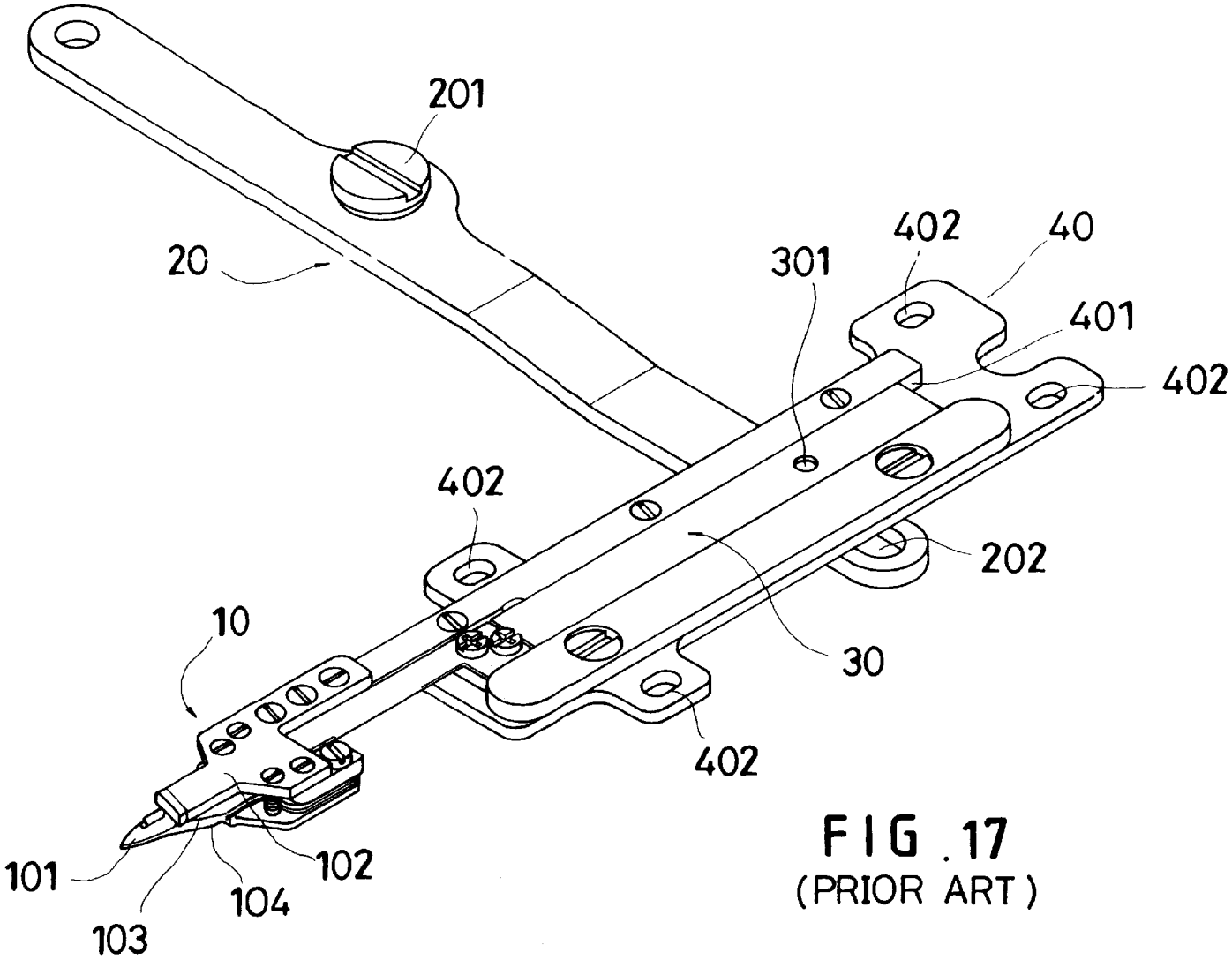
FIG. 17 (PRIOR ART)
FIG. 17 is a perspective view of a conventional thread cutting device for a sewing machine of chain sewing.
Figure 20:
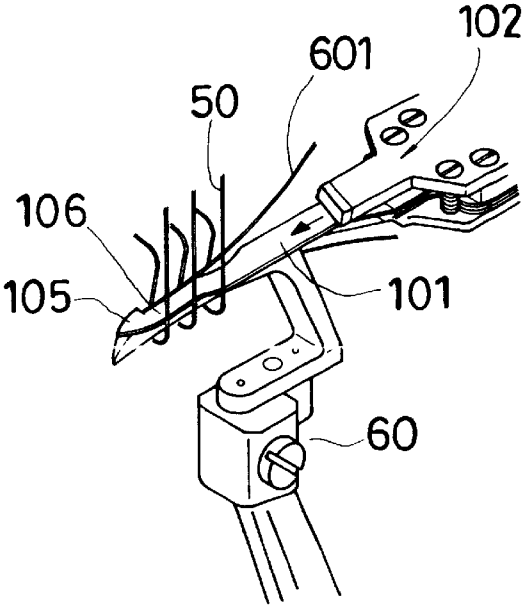
FIG. 20 (PRIOR ART)
FIG. 20 is a perspective view of the conventtional thread cutting device in a second operation stage wherein the movable knife is extended out to an outermost point.
Figure 19:
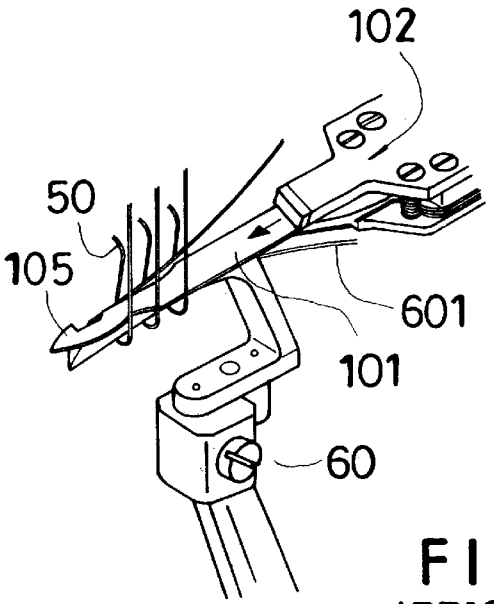
FIG. 19 (PRIOR ART)
FIG. 19 is a perspective view of the conventional thread cutting device in a first operation stage wherein the movable knife is being extended out.
Figure 18:
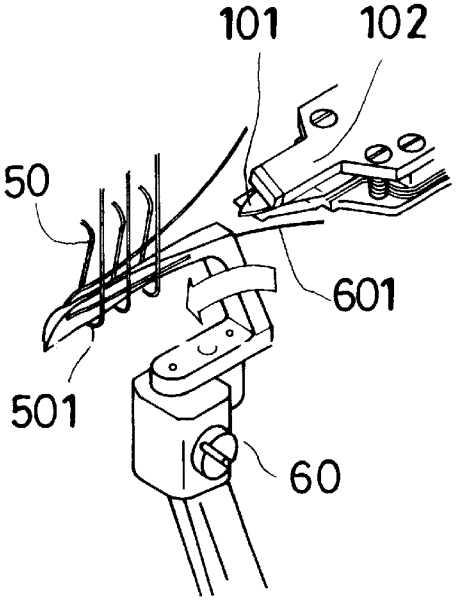
FIG. 18 (PRIOR ART)
FIG. 18 is a perspective view of the relative position of the conventional thread cutting device and the hooking activator.
Figure 22:
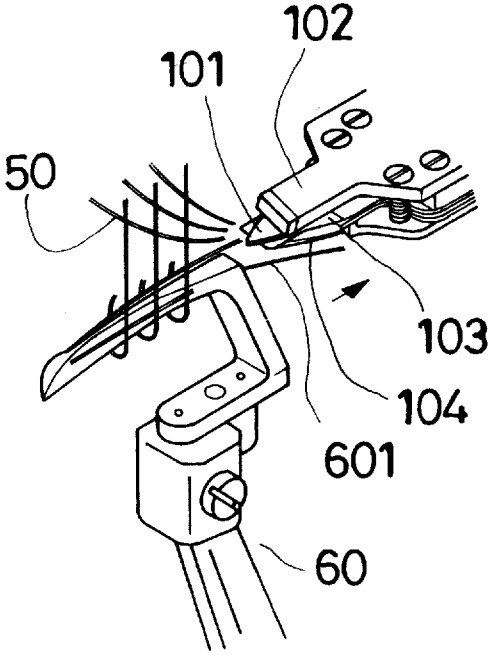
FIG. 22 (PRIOR ART)
FIG. 22 is a perspective view of the conventtional thread cutting device in a forth operation stage wherein the movable knife is retracted to a starting point, finishing a round of cutting action.
Figure 21:
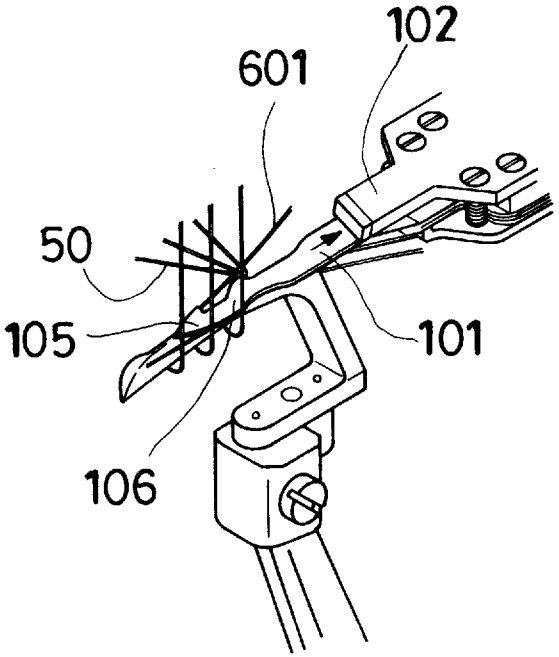
FIG. 21 (PRIOR ART)
FIG. 21 is a perspective view of the conventional thread cutting device in a third operation stage wherein the movable knife is being retracted back.

When sewing operation is finished and thread cutting operation is to be started, the cutting device is moved by the air pressure cylinder 51, with the swing arm 4 moved at the same time. Thus, the first post 43 of the swing arm 4 slides in the curved guide slot 21 of the combine plate 2, moved by the spring 14 located between the fixing plate 1 and the combine plate 2. Then the combine plate 2, the slide guider 3 and the movable knife 34 fixed with the front end of the slide guider 3 are pushed forth and back, But the slide guider 3 together with the combine plate 2 cannot move up, can only move back and forth, owing to the U-shaped groove 291 of the elastic guider 29, as shown in FIGS. 10 and 11. So the movable knife 34 moves further until the swing arm 4 stops, with the rear hook 342 of the knife 34 hooks a thread circle 501, as shown in FIG. 12. In retracting movement of the swing arm 4 by the air pressure cylinder 51, the movable knife 34 is also retracted both outward and backward by the first and the second posts 43, 44 of the swing arm 4, with the movable knife 34 hooking and pulling backward the thread circles 501 formed by the circulating thread or warp 601 and the weaving thread or woof 50 by means of the front and the rear hook 341 and 342 as shown in FIG. 13. When the swing arm 4 finishes retracting operation, the movable knife 34 shrinks in the main knife 25, which then cuts the woof 601 and the warp 50 at the same time, with the woof 601 also clamped by the clamp set 27. Meanwhile, the thread cutting device swings and returns to the original position to the outside of the sewing machine 5, completing one round of cutting process and ready for the next cutting operation, as shown in FIG. 14.

Provided that the movable knife 34 of the string cutting device should be found to have errors in extending-out to the outermost position and in hooking and cutting threads to result in malfunction, the bolt 411 in the hole 41 of the swing arm 4 might be loosened, with the cylindrical gasket 42 properly rotated for a minute angle so that the lower eccentric edge 421 may be moved, with the mark 422 as a standard, letting the starting point of the swing arm 4 properly adjusted to permit the movable knife 34 move to the correct outermost point for hooking and cutting threads accurately again.

The present invention has advantages as follows, as can be understood from the aforesaid description.

1. The movable knife extends in a short distance as possible as can be, for minimizing malfunction in hooking and cutting threads, by positioning normally the cutting device at the outside of the table of a sewing machine during operation of sewing to avoid swinging space of the hook maker.
2. The threads cut have the shortest protruding length after they are pulled back and cut by the cutting device, facilitating subsequent work and enhancing outer appearance of a product, because the cutting device is located very near to the hook maker and the needle.
3. The lower eccentric edge of the cylindrical gasket of the swing arm can be rotated for adjusting its angle so that the distance of extending-out of the movable knife may be adjusted, facilitating adjusting process for correcting malfunction of the movable knife and augmenting smoothness of operation.

While the preferred embodiment of the invention has been described above, it will be recognizes and understood that various modifications may be made therein and the appended claims are intended to cover all such modifications which may fall within the spirit and scope of the invention.

What is claimed is:

1. A thread cutting device for a sewing machine of chain sewing, comprising:

a fixing plate fixed on a table of a sewing machine with bolts, having a preset shape and a threaded hole in one end;

a combining plate having a front end combined with a main knife and a clamp set;

a slide guider coupled to said combining plate, having a front end fixedly coupled to a knife provided with a front hook and a rear hook on a front end thereof;

a swing arm having a hole in a middle portion for a bolt to fix said swing arm with said fixing plate through a cylindrical gasket, which functions as a fulcrum, and an end connected pivotally with an outer end of a piston rod of an air pressure cylinder;

said combining plate having a curved guide slot in an intermediate portion, a first end coupled to a guide plate and provided with plural threaded holes and a position hole, said position hole receiving a bolt to combine said combining plate with said fixing plate through a cylindrical gasket.

2. The thread cutting device for a sewing machine of chain sewing as claimed in claim 1, wherein a spring is provided between said combining plate and said fixing plate in such a way that one side of said curved guide slot of said combining plate rests on said post of said swing arm.

3. The thread cutting device for a sewing machine of chain sewing as claimed in claim 1, wherein a guider is fixed on said combining plate by screws engaging two holes in two ends of said guider and two threaded holes in one end of said combining plate.

4. The thread cutting device for a sewing machine of chain sewing as claimed in claim 1, wherein said combining plate has its front end bored with a hole for a bolt and nut to fix an elastic guider having a U-shaped groove under said combining plate, with said U-shaped groove opening in the same direction as a displacement direction of said knife.

5. The thread cutting device for a sewing machine of chain sewing as claimed in claim 1, wherein said lower edge of said cylindrical gasket of said swing arm is shaped as an eccentric circle.

6. The thread cutting device for a sewing machine of chain sewing as claimed in claim 1, wherein said cylindrical gasket has a mark formed on an upper surface thereof for providing a standard for adjusting the displacement distance of said knife.

7. The thread cutting device for a sewing machine of chain sewing as claimed in claim 1, wherein said second post of said swing arm is pushed in place by said knife after protruding through said limit washer and said long slot of said slide guider.

* * * * *